United States Patent [19]

Marshall, Jr. et al.

[11] 4,289,307

[45] Sep. 15, 1981

[54] RIDING TOY WITH SOUND EFFECTS

[75] Inventors: Trevor J. Marshall, Jr., Westport, Conn.; Darryl R. Dworkin, Middlesex, N.J.

[73] Assignee: CBS Inc., New York, N.Y.

[21] Appl. No.: 10,780

[22] Filed: Feb. 9, 1979

[51] Int. Cl.[3] ..... A63G 17/00

[52] U.S. Cl. ..... 272/52.5; 340/384 E

[58] Field of Search ..... 272/14, 52, 52.5, 53.1, 272/53.2; 46/232, 174, 175 R, 175 AR, 177, 111, 112, 117, 118; 331/78; 340/384 E; 35/12 Q; 84/1.01

[56] References Cited

U.S. PATENT DOCUMENTS

| | | | |
|---|---|---|---|
| 2,437,015 | 3/1948 | Baltz | 272/52 |
| 2,675,234 | 4/1954 | Reames | 272/52.5 |
| 2,733,548 | 2/1956 | Sebel | 46/175 R |
| 2,882,050 | 4/1959 | Deady | 272/53.2 X |
| 2,915,312 | 12/1959 | Barthel | 272/53.2 |
| 2,921,789 | 1/1960 | Skinner, Sr. | 272/53.2 |
| 2,971,758 | 2/1961 | Zimmers | 272/52.5 X |
| 3,090,618 | 5/1963 | Brent | 272/53.2 |
| 3,160,983 | 12/1964 | Smith et al. | 46/232 |
| 3,495,794 | 2/1970 | Polk, Jr. | 272/52 X |
| 3,913,097 | 10/1975 | Schedler | 340/384 E |
| 3,922,944 | 12/1975 | Kurosaki et al. | 84/1.01 |
| 4,043,241 | 8/1977 | Liu | 84/1.01 |
| 4,157,826 | 6/1979 | Sims et al. | 272/53.2 |

*Primary Examiner*—William H. Grieb

*Attorney, Agent, or Firm*—Spencer E. Olson

[57] ABSTRACT

A model horse is resiliently mounted to permit a child rider to cause motion of the horse having vertical and/or horizontal motion components. A trotting gait sound is generated in response to detected vertical motion, and a walk and/or gallop gait sound is generated in response to detected horizontal motion. The selection as between the walk and gallop gait is preferably based upon the amplitude or horizontal motion. The different gait sounds are obtained by generating a basic "clop" (hoofbeat) sound, and, repeating the clop sound in a different time sequence for each gait. In the preferred embodiment of the invention, the sounds of a horse's "snort" and "whinny" are also generated during riding. The sounds produced in accordance with the invention are obtained by digitally forming audio frequency signals and controlling the envelope of the audio frequency signals.

22 Claims, 18 Drawing Figures

RIDING TOY WITH SOUND EFFECTS

BACKGROUND OF THE INVENTION

This invention relates to riding toys and, more particularly, to a riding toy such as a hobby horse which automatically generates different realistic sounds that are coordinated with the motion of the toy as determined by the impetus of the riding child.

The prior art contains various types of riding toys including, for example, "hobby horses" disclosed in the U.S. Pat. Nos. 2,437,015 and 3,495,794.

Prior art mechanisms have been proposed for making sounds during the riding of a toy. See, for example, U.S. Pat. No. 2,971,758. While prior art schemes provide for sounds to accompany the riding of a toy, the degree of realism of the sounds is limited in a number of respects. For example, with respect to a riding horse, realistic galloping sounds have not been readily produced. Also, galloping sounds are anomalous during a slow rocking motion of the rider, or during up and down trotting-like motion. Also, other oral and nasal sounds made by a horse, which provide further realism, have not been realistically simulated in prior art riding toys.

It is an object of the present invention to provide a riding toy that automatically produces different realistic sounds that correspond to the type of motion and/or the riding sequence of the child using the toy.

SUMMARY OF THE INVENTION

The present invention is directed to a riding toy which automatically produces sounds related to its motion. In accordance with the invention, a riding vehicle is resiliently mounted to allow motion in at least two directions. Means are provided for detecting components of motion in the two directions. Means are also provided for generating at least two different sounds which respectively relate to the detected components of motion, so as to provide a realistic relationship between the motion of the vehicle and the sounds. A child riding the toy thereby receives realistic aural feedback as a result of different types of motion he or she causes on the toy.

In the preferred form of the invention a model horse is resiliently mounted to allow a rider thereof to cause motion of the horse having vertical and/or horizontal motion components. A trotting gait sound is generated in response to detected vertical motion, and a walk and/or gallop gait sound is generated in response to detected horizontal motion. The selection as between the walk and gallop gait is preferably based upon the amplitude of horizontal motion.

In the preferred embodiment of the invention, there is provided further means responsive to detected motion of the horse for generating sounds which simulate oral and/or nasal horse sounds. In particular, the sounds of a horse's "snort" and "whinny" are generated during riding. The sounds produced in accordance with the invention are obtained by digitally forming audio frequency signals and controlling the envelope of the audio frequency signals. The frequency of the audio frequency signals is also varied digitally. The result is the controlled generation of various realistic horse sounds with a minimum of circuitry.

In accordance with a further feature of the invention, the different gait sounds are obtained by generating a basic "clop" (hoofbeat) sound, and, repeating the clop sound in a different time sequence for each gait.

Further features and advantages of the invention will become more readily apparent from the following detailed description when taken in conjunction with the accompanying drawings.

DESCRIPTION OF THE PREFERRED EMBODIMENT

Figure 1:
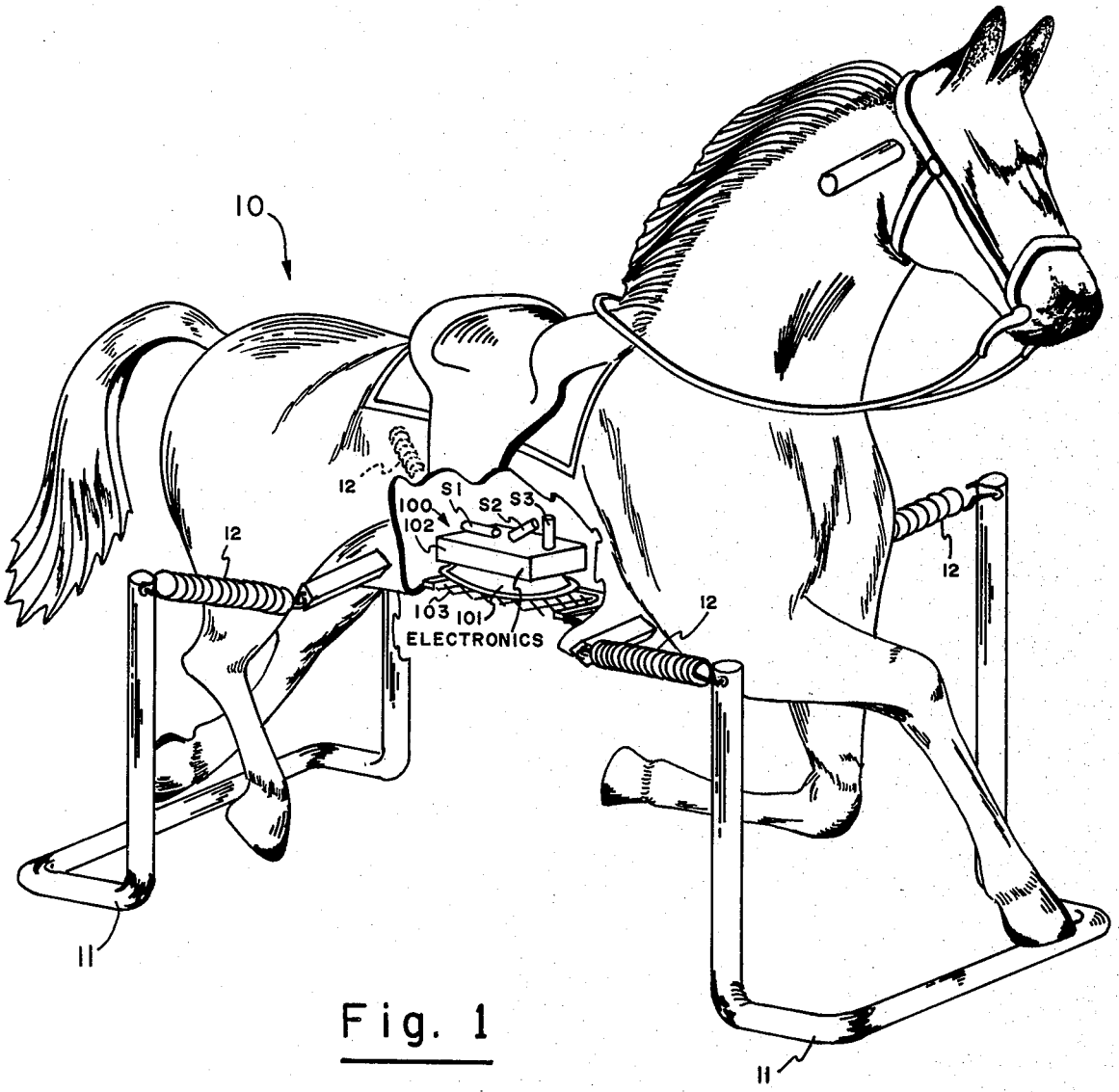
FIG. 1 illustrates a riding horse which includes features in accordance with the present invention.

Referring to FIG. 1, there is shown a toy riding horse or "hobby horse" which includes features in accordance with an embodiment of the invention. A model horse 10, formed for example of a hollow molded plastic, is mounted on a stand 11 via four springs 12 as disclosed, for example, in the U.S. Pat. No. 3,495,794.

Mounted within the model horse 10 (by any suitable means, not shown) is an electronics package 100, a speaker 101, and a battery, 102. the speaker is preferably coupled to an acoustical low pass filter (not shown) whose output faces a removable apertured cover plate 103 in the bottom of horse model 10. Switches designated S1, S2 and S3, which may, for example, be mercury switches, are mounted within the model horse. These switches may be mounted on the housing of the electronics 100, or at any other suitable locations within the model horse. The switches are oriented in different directions. In the present embodiment, the switch S1 is oriented substantially horizontally, the switch S3 is oriented substantially vertically, and the switch S2 is oriented at an angle between the vertical and the horizontal. With this arrangement, the switch S1 is most sensitive to horizontal components of motion and the switch S3 is most sensitive to vertical components of motion. The switch S2 is somewhat sensitive to both components of motion, and is used herein as a less sensitive detector of horizontal motion; i.e., to sense horizontal motion of greater amplitude than that needed to activate S1. The switches S1, S2 and S3 are electrically coupled to the electronics 100 as will be described momentarily.

Figure 2:
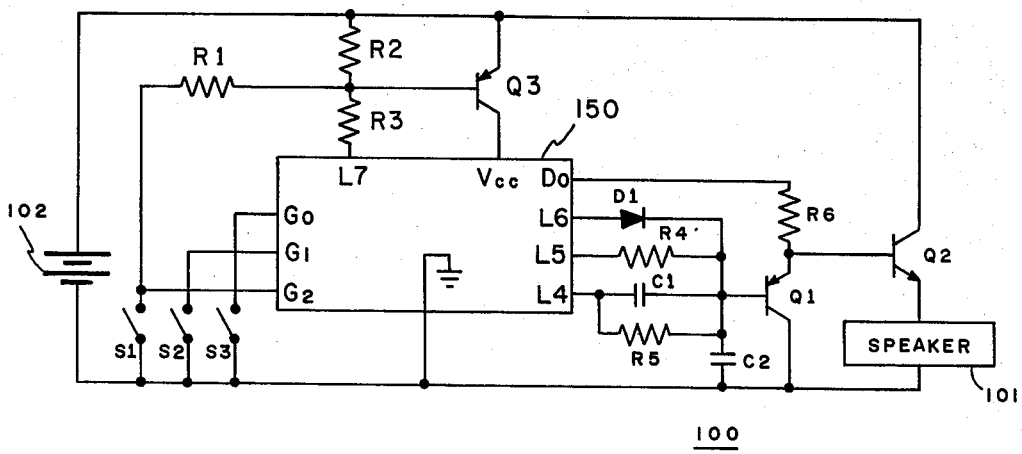
FIG. 2 is a schematic diagram of the sound-generating circuitry of the FIG. 1 riding horse.

Referring to FIG. 2, there is shown a schematic diagram of the electronics 100 of the FIG. 1 embodiment, along with the battery 102, speaker 101, and switches S1, S2 and S3, to which the electronics is coupled. A microprocessor integrated circuit 150 is provided, and is programmed to operate in the manner described hereinbelow. In one operating embodiment of the invention, a Model COP411L microprocessor, manufactured and sold by National Semiconductor Corporation, was utilized, although it will be understood that, if desired, other microprocessor circuits, or digital or analogue control circuitry, could be utilized to implement the functions to be set forth. The COP411L chip has a conventional type of programmable microprocessor architecture described, for example, in published specifications available from National Semiconductor Corporation. Input sensing and energizing lines are designated G0, G1, G2, and Vcc. Output lines are designated D0, L4, L5, L6 and L7. Under control of the microprocessor 150, the input lines are operative to sense the binary status of the signals coupled thereto, and the output lines are operative to couple a desired binary state to the lines coupled thereto.

The switches S1, S2, and S3 have one terminal respectively coupled to the input terminals G2, G1 and G0. The opposite terminals of these switches are each coupled to ground reference potential. The input terminal G2 is also coupled, via resistor R1, to the junction between a pair of resistors R2 and R3. The other end of resistor R2 is coupled to the positive side of battery 102, the negative side of battery 102 being coupled to ground reference potential. The other end of resistor R3 is coupled to output terminal L7. A PNP transistor Q3 has its base coupled to the junction between resistors R2 and R3. The emitter of Q3 is coupled to the positive side of battery 102, and the collector of Q3 is coupled to the terminal Vcc. The positive side of battery 102 is also coupled to the collector of an NPN transistor Q2, the emitter of this transistor being coupled to one input terminal of speaker 101. The other input terminal of speaker 101 is coupled to ground reference potential. The base of transistor Q2 is coupled to output line D0 via resistor R6. The base of transistor Q2 is also coupled to the emitter of PNP transistor Q1, the collector of Q1 being connected to ground reference potential. The base of Q1 is coupled to ground reference potential via capacitor C2 and to output terminal L4 via the parallel combination of capacitor C1 and resistor R5. The base of transistor Q1 is also coupled to output terminal L5 via resistor R4 and to output terminal L6 via diode D1.

Operation of the circuitry of FIG. 2 will be fully understood once the programming of microprocessor 150 is described hereinbelow. Briefly, however, it can be noted that the status of switches S1, S2 and S3 are periodically sensed via input lines G2, G1 and G0, and the power to microprocessor 150 is controlled via terminal Vcc under control of transistor Q3. The various sounds produced by speaker 101 are generated by application of appropriate control signals to the control terminals D0, L4, L5, and L6, to drive the transistor Q2 via the illustrated circuit components.

Figure 3:
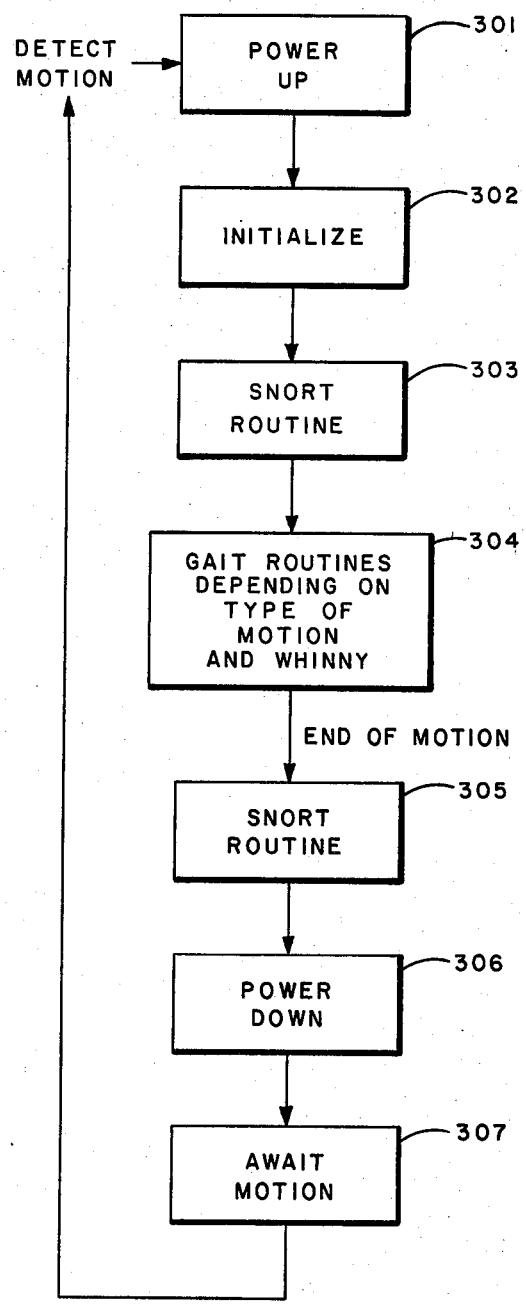
FIG. 3 is a simplified overall flow diagram useful in gaining an initial understanding of the invention.

Referring to FIG. 3, there is shown a simplified block diagram which is useful in understanding, in broad terms, ther overall operation of the FIG. 1 embodiment. The power to the microprocessor is off until motion of the horse is detected by switch S1. When switch S1 closes (FIG. 2), transistor Q3 is turned on, which results in powering of microprocessor 150 via terminal Vcc. As will be described further hereinbelow, the power is then maintained on by having terminal L7 go low to keep Q3 on, this being continued until a "power down" condition is later warranted. The "power up" condition is represented in FIG. 3 by the block 301. After "power up", certain initializing functions are performed within the microprocessor 150 as will be described hereinafter. This initialization is represented by the block 302 of FIG. 3.

Virtually immediately after sensing motion, the electronics is operative to generate sound-representative signals of various types. There are two general classes of sounds produced in the present embodiment. The first class of sounds are sounds which simulate the gait of a horse; in particular, the sound of a walking gait, the sound of a galloping gait, and a sound of a trotting gait. In realistic manner, different sounds are selected in dependence upon the type of motion of the horse. A further predetermined sequence of sounds, representative of oral and/or nasal sounds made by a horse, are also provided during riding. In particular, "snort" sounds and "whinny" sounds are provided in a sequence during riding.

Referring again to FIG. 3, the block 303 represents a snort sound which is generated almost immediately after initial motion is detected (since power up and initialization takes only milliseconds). The block 304 represents the routines for generating the gait-simulating sounds depending upon the type of motion during riding. Also, at irregular intervals during riding a "whinny" sound is generated, as further indicated by the block 304. When the end of motion is sensed, block 305 is entered and another "snort" sound is generated. Power to the microprocessor is then turned off (block 306), this being achieved by having output line L7 (FIG. 2) go high, which turns off transistor Q3. After "power down", the next motion is awaited (block 307), and upon detecting of motion, block 301 is entered. It should be emphasized that the purpose of FIG. 3 is to aid in a simplified explanation of overall operation, the actual routines for achieving the functions described therein being set forth in detail hereinbelow. Summarizing the overall operation of the embodiment of FIG. 1, the riding horse snorts at the beginning and end of riding, it whinnies at irregular intervals during riding, and it generates a walk, gallop, or trot gait during riding, depending upon the type of riding motion.

Figure 4:
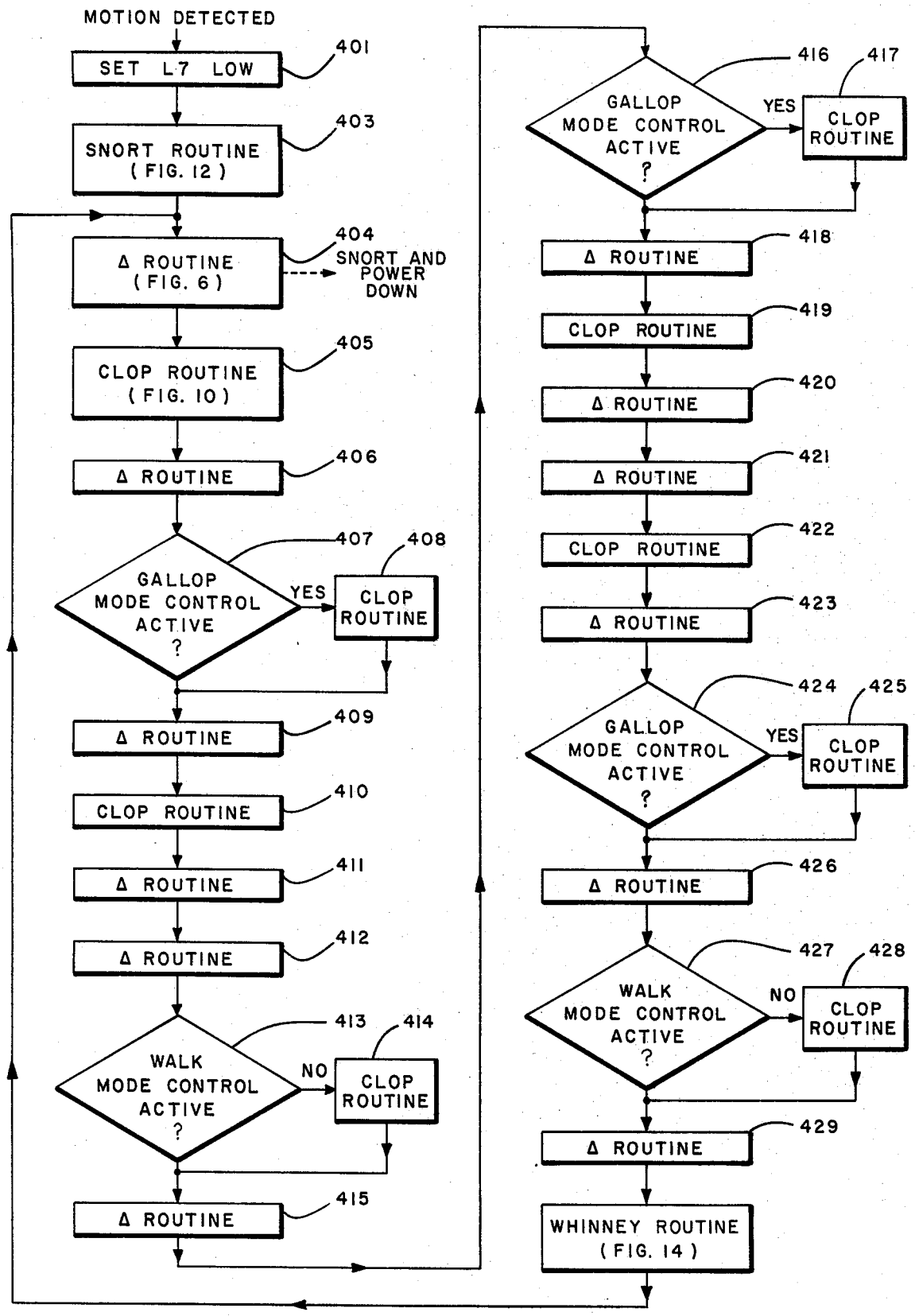
FIG. 4 is a flow diagram of the main routine for practicing the invention.

FIG. 4 is a flow diagram suitable for programming a microprocessor, such as the microprocessor 150 of FIG. 2, to perform the functions described broadly in conjunction with FIG. 3 and to be set forth in further detail hereinbelow. The flow diagram of FIG. 4 represents the main operational program sequence, and reference will be made to figures to describe various subsidiary routines.

Figure 5:
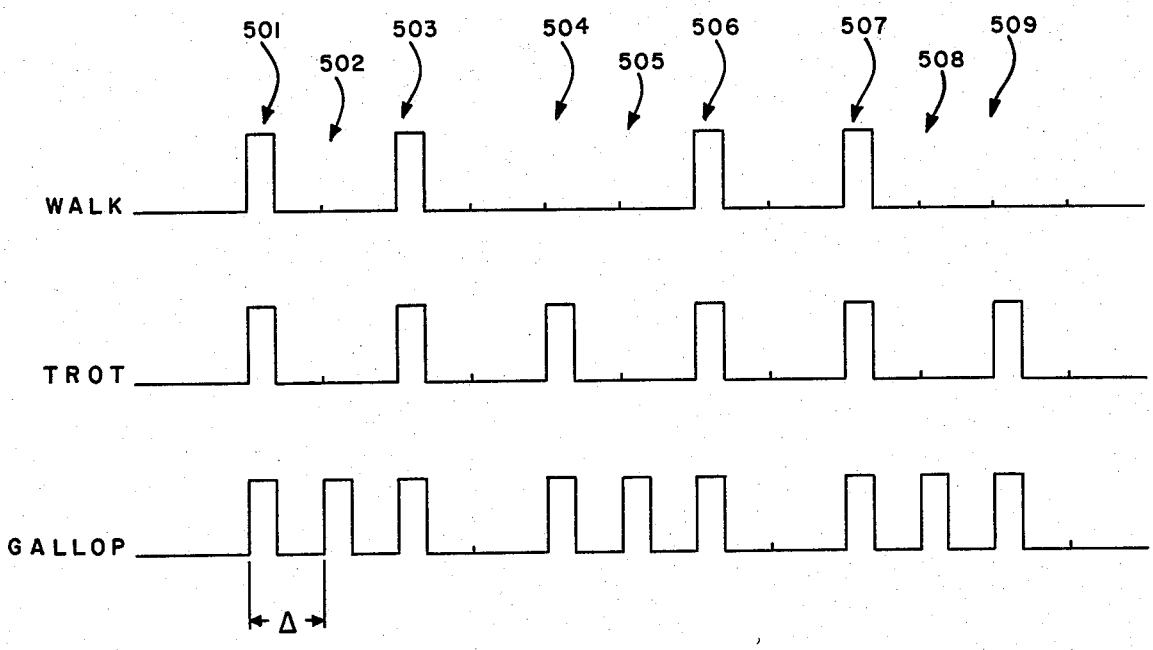
FIG. 5 is a timing diagram which illustrates the manner in which the various gaits of the invention are generated.

Before proceeding with description of the main program, reference is made to FIG. 5 for an understanding of the timing of the sounds generated to simulate the different gaits of the horse 10. Each of the gaits uses a basic sound element called "clop" which represents a single-beat and is generated in a manner described hereinbelow. In FIG. 5 each pulse in the timing diagram represents a "clop", and it is seen that the difference in gaits is obtained by varying the timing of clops. Examining the gallop gait first, it is seen that triplets of clops are used, with the basic time period between the clops of a triplet being designated as Δ. The characteristic time between triplets of the gallop is 2Δ. The time Δ is about 110 milliseconds in the present embodiment. In the case of the trot, the clops are evenly spaced apart by a time 2Δ. For the walk gait, a pair of clops is separated by the time 2Δ (like the trot), but the time until the beginning of the next pair of clops is 4Δ. In the diagram of FIG. 5, a full sequence of gallop, trot, and walk gait sounds are shown over a basic time period 12Δ.

Referring again to FIG. 4, when Vcc goes high after initial motion is detected (switch S1 closed) output terminal L7 is brought low (block 401) to maintain the transistor Q3 on. It will be understood that for switches such as the mercury switches of the FIG. 1 embodiment, an activated switch will not be continuously closed or opened, but will intermittently close and open as the mercury bounces onto and off the contacts of the switch. In the present embodiment, the minimum threshold motion of the horse is not considered as having ceased until no motion is detected for a predetermined period, as will be described below. After terminal L7 is brought low, block 403 is entered and a snort sound is generated, the routine for obtaining the snort sound being described in conjunction with FIG. 12. The block 404 is then entered, this block representing a routine known as the "Δ routine" which is described in conjunction with FIG. 6. The Δ routine takes a time Δ to perform, the time Δ being about 110 milliseconds in the present embodiment, as noted above. The Δ routine will be described shortly hereinafter. For present purposes, however, it suffices to say that during the Δ routine, the statuses of switches S1, S2 and S3 are sampled to determine which, if any, of these switches are closed (i.e., "active"). Since more than one switch may be active during the time Δ, the Δ routine is also operative to establish which gait should be simulated in accordance with priority rules. In particular, the present embodiment gait priority sequence, from highest to lowest, is: trot, gallop, walk, off. Thus, if the trot switch is active, then a trotting gait is effected regardless of whether other switches are active. As between the other two switches (assuming the trotting switch is inactive), the gallop gait takes priority. As will also be apparent during description of the Δ routine, certain conditions must be met before switching from one gait to another so that undesirable oscillating between different gaits does not occur. Finally, the Δ routine is used to keep track of when motion has ceased, whereupon the final snort sound is generated and the power is shutdown. This type of exit from the Δ routine is indicated in FIG. 5, block 404, by a dashed arrow. It will be understood that such an exit could occur from other instances of the Δ routine in FIG. 5, but the dashed arrow is not repeated for clarity of illustration.

Figure 10:
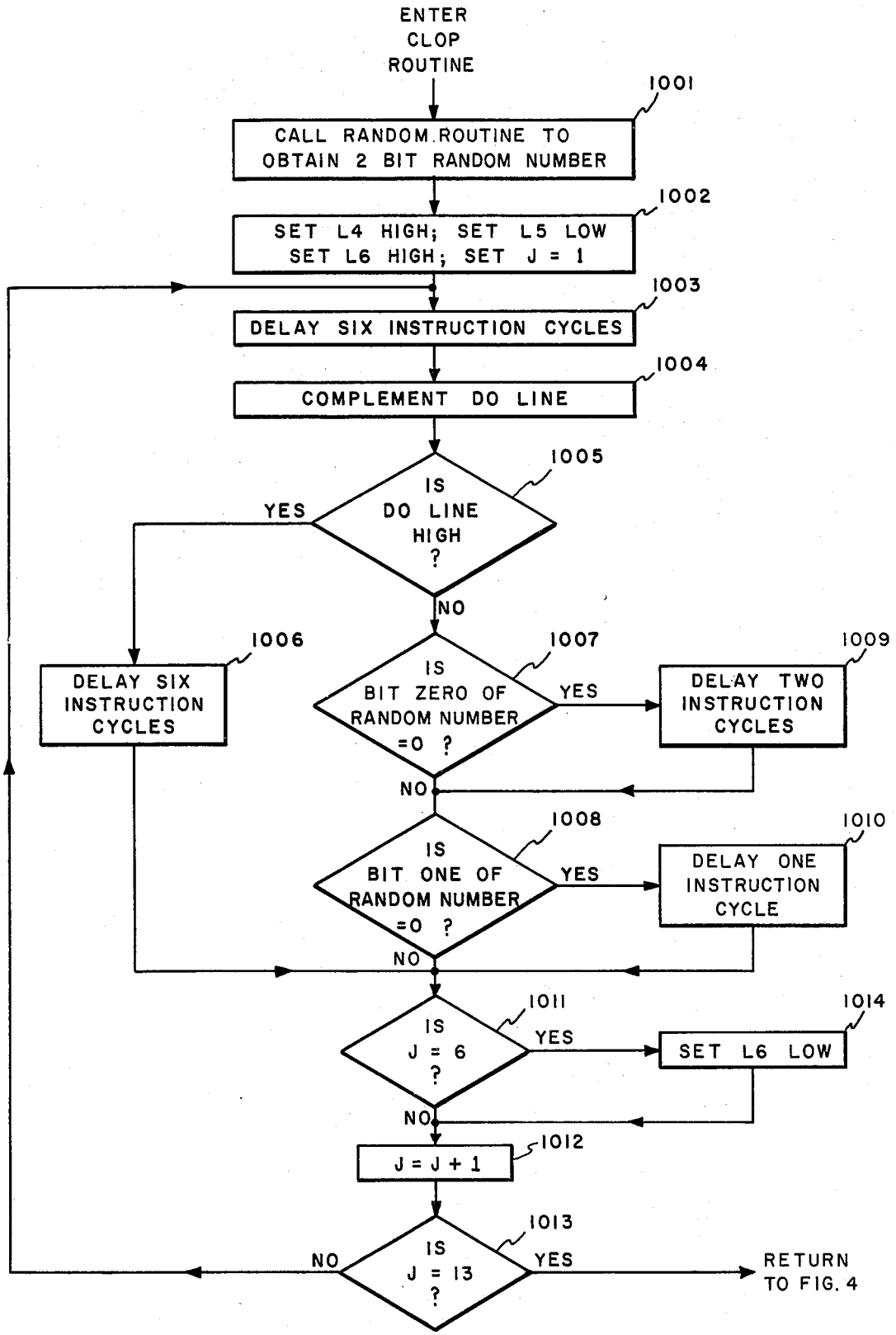
FIG. 10 is a flow diagram of the routine for obtaining the clop sound.

Returning to the description of FIG. 4, after the Δ routine of block 404, block 405 is entered, this block representing the routine, described in conjunction with FIG. 10, for generating a clop sound. This clop is the left-most clop 501 of the FIG. 5 timing diagram, regardless of which gait mode is active. Block 406 is then entered and the Δ routine is repeated. Diamond 407 is then entered, and inquiry is made as to whether or not the gallop mode control is active. This determination will have been made during the Δ routine (to be described) by the activation of a "gallop mode control". If the gallop mode control is active, block 408 is entered, this block representing the generation of another clop sound (again, the routine of FIG. 10). It can be seen in FIG. 5 that this is the clop 502 which occurs after one Δ time period when generating the gallop gait sound. If the gallop mode control is not active, the "no" output branch of diamond 408 causes this clop to be skipped (as would be indicated for either a trot or a walk) and the Δ routine is again performed, as indicated by block 409. After the Δ routine of block 409, the block 410 is entered and the next clop sound is generated, this being the clop 503 of FIG. 5, which is seen to occur for all three possible gaits.

The Δ routine is then repeated twice more (blocks 411 and 412), which takes a time 2Δ, and decision diamond 413 is then entered for a determination as to whether the walk mode control is active. As seen from FIG. 5, at this time in the sequence a clop should be generated for either trot or gallop (clop 504), but not for walk. Accordingly, the "no" output branch of diamond 413 leads to block 414 which generates the clop 504, whereas the "yes" output branch of decision diamond 413 causes entry directly to block 415, which represents another performance of the Δ routine.

Decision diamond 416 is next entered and determination is made as to whether or not the gallop mode control is active, this being done so that the clop 505 can be generated by block 417 if the gallop mode control is active, and skipped otherwise. The blocks 418 through 423 then represent, in sequence, the generation of clop 506 (block 419) a time 2Δ (blocks 420 and 421) and a clop 507 (block 422), these clops being generated regardless of which gait mode control is active. The decision diamond 424 is then entered and determination is made as to whether or not the clop 508 (block 425) should be generated. Then, in similar fashion to before, another Δ routine (block 426) is performed, and the status of the walk mode control is tested (decision diamond 427) to determine whether clop 509 should be generated (block 428), which will be done when other than the walk mode control is active, and which will be omitted when the walk mode control is active, as is again seen from FIG. 5. The Δ routine is then again performed (block 429). The whinny routine is next called (block 430), as described in conjunction with FIG. 14. Block 404 is then reentered to start the pattern again.

Figure 6A:
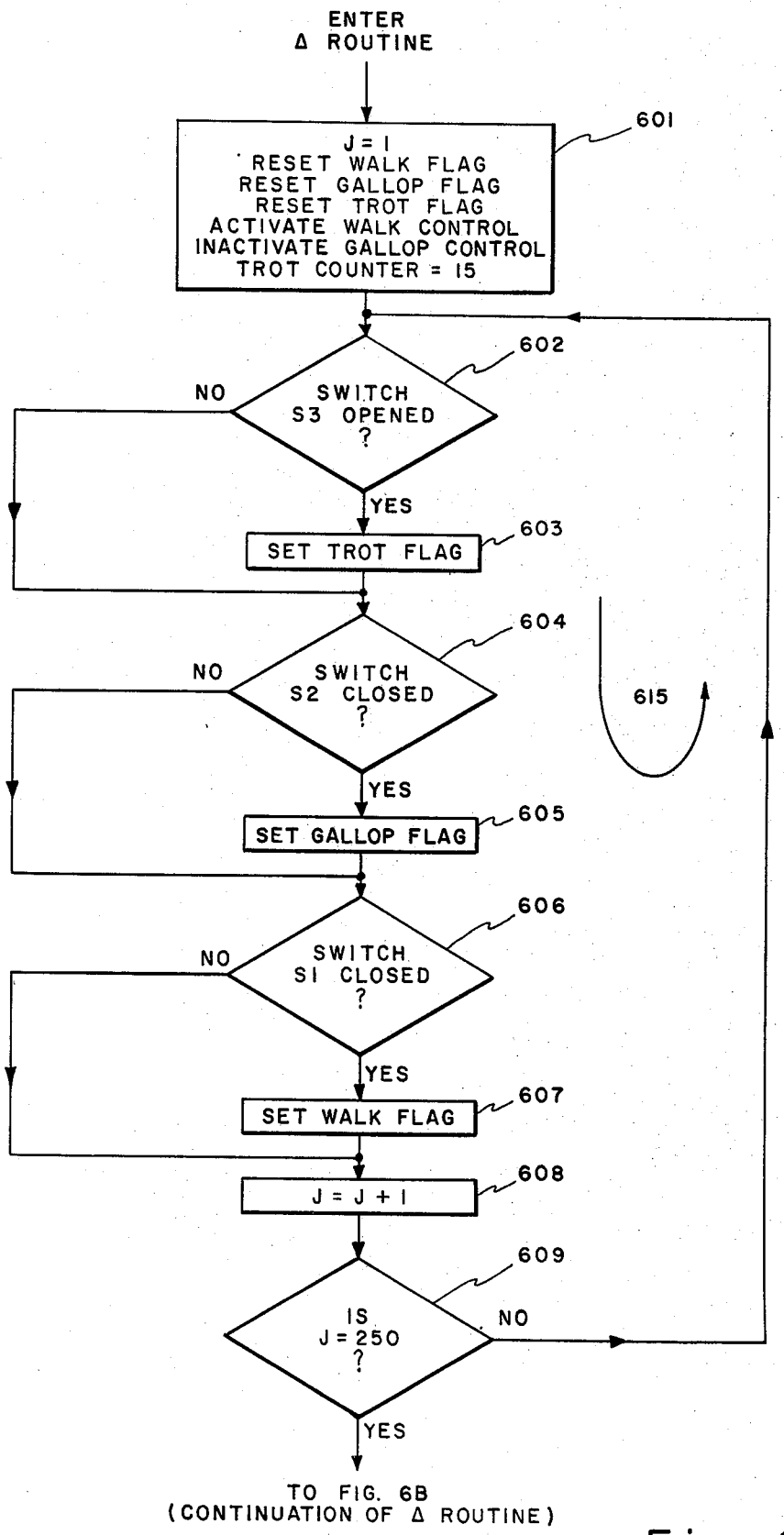
FIG. 6, which includes FIG.S 6A and 6B, is a flow diagram of the Δ routine of FIG. 4.
Figure 6B:
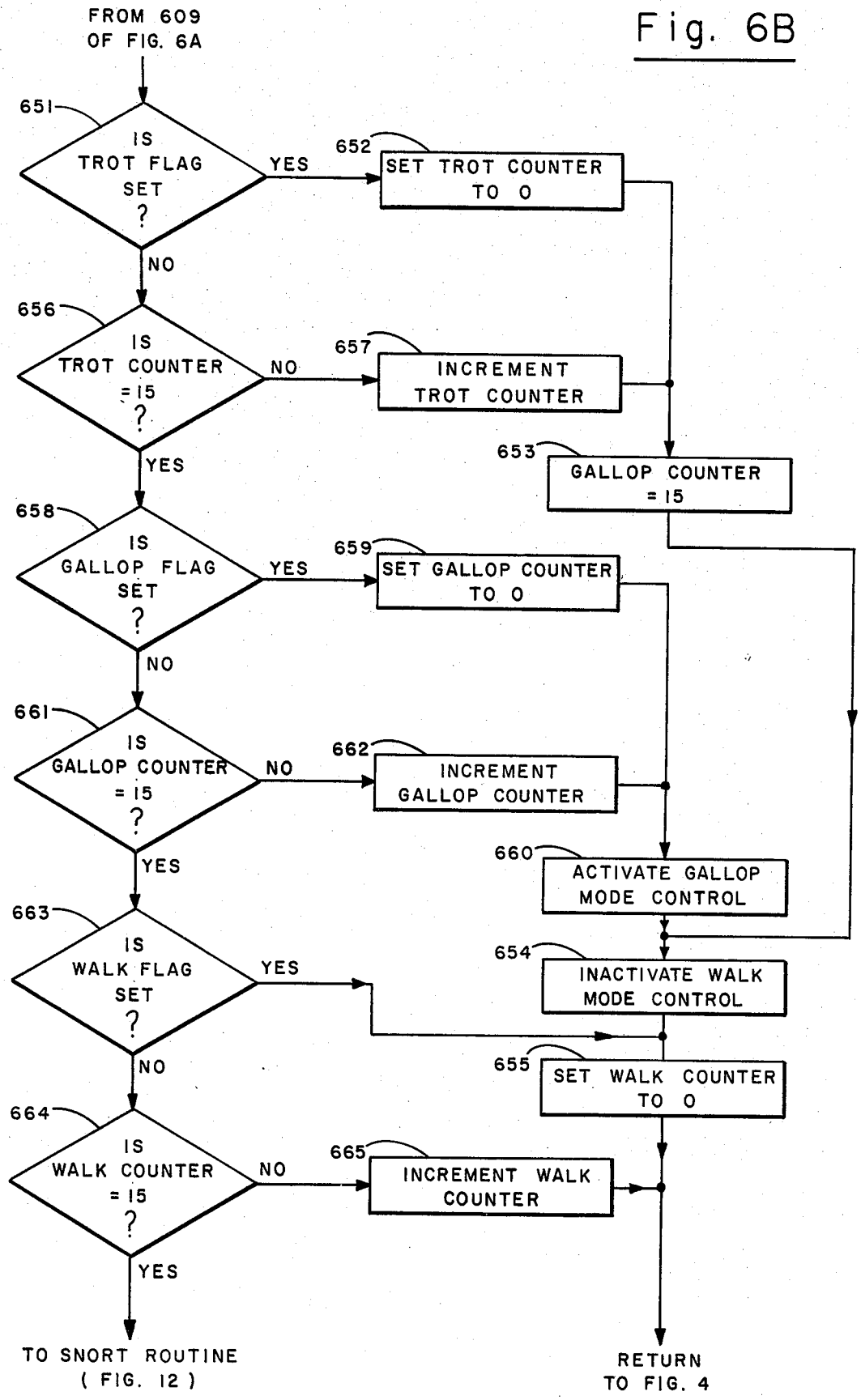

Referring to FIG. 6, there is shown a flow diagram of the Δ routine used in the FIG. 4 main program. The block 601 is initially entered and initialization of certain indices and controls is implemented. In particular, an index J is set to 1, all flags are reset, the walk mode control is activated, the gallop mode control is inactivated, and a trot counter is set to 15. The purposes of these actions will be clarified shortly. After initialization, a loop 615 is entered, this loop being utilized to effect the sampling of the switches S1, S2 and S3 during the Δ routine. In the present embodiment, the sampling rate for each switch is at 2.23 KHz and the status of each switch is sampled (by sensing the state of the input terminal to which it is attached) 250 times during each Δ routine. In this manner, sampling is at a high enough rate compared to the switch closure rate and period to insure that switch closures are not missed. In operation of the loop 615, the decision diamond 602 is entered, and inquiry is made as to whether the switch S3 is active. In the case of the vertically oriented switch S3, the contacts are on the bottom and the switch is normally closed, so an opened switch indicates an active condition. If so, a "trot flag" is set (block 603). Decision diamond 604 is then entered, and inquiry is made as to whether or not the switch S2 is active. If so, a "gallop flag" is set (block 605). Decision diamond 606 is then entered and inquiry is made as to whether the switch S1 is active and, if so, a "walk flag" is set (block 607). The index J is then incremented (block 608) and decision diamond 609 is entered to test the index J and determine if 250 passes through the loop have been performed. Thus, by the time of an exit from loop 615, via the "no" branch of diamond 609, each switch has been sampled 250 times, and a flag associated with each switch has been set if the associated switch was active during any sampling time of the loop.

The remainder of the Δ routine is involved with activation of the appropriate gait mode control (consistent with the priority rules) and to handle certain timing considerations with regard to switching between different gaits or exiting toward a "power down". Diamond 651 is entered and inquiry is made as to whether the trot flag is set (i.e., whether or not the trot switch S3 was active during the justdescribed sampling period. If so, the trot counter is reset to zero (block 652). A gallop counter is set to 15 (block 653), and the walk mode control is inactivated (block 654), followed by a walk counter being set to zero (block 655).

Figure 12:
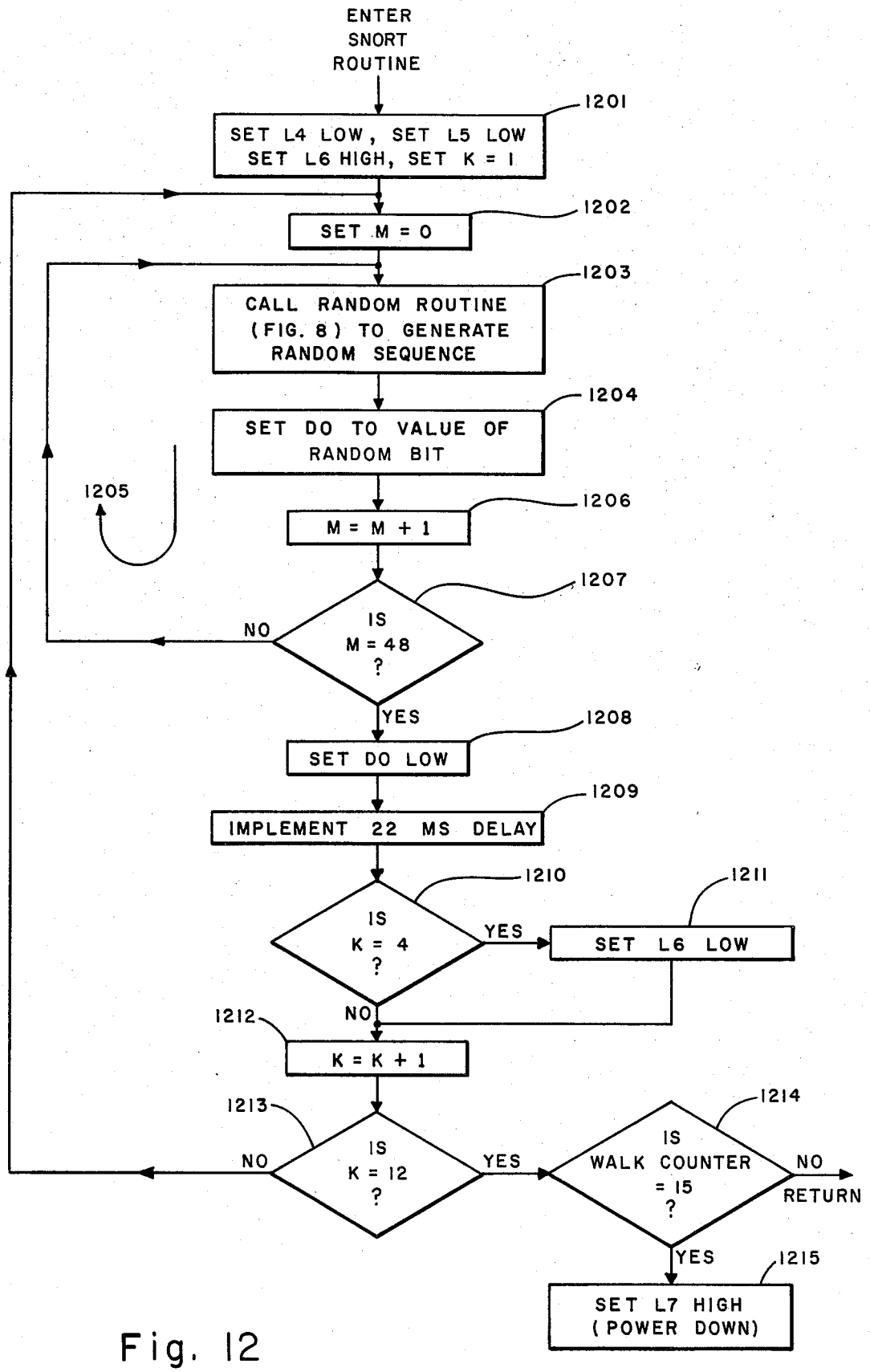
FIG. 12 is a flow diagram of the routine for obtaining the snort sound.

If the determination of decision diamond 651 had indicated that the trot switch had not been activated during the sampling period, diamond 656 is entered to see if the trot counter has run out (i.e., has reached its maximum value of 15). If not, the trot counter is incremented (block 657) and block 653 is entered. If, however, the trot counter does equal 15 (indicative of fifteen Δ intervals since a trot switch activation), diamond 658 is entered, and inquiry is made as to whether the gallop flag is set. If so, the gallop counter is restarted at 0 (block 659), the gallop mode control is activated (block 660), and then block 654 is entered. If the determination of diamond 658 is negative, inquiry is then made (diamond 661) as to whether the gallop counter has reached 15. If not, the gallop counter is incremented (block 662), the block 660 is entered. If the gallop counter had been found to be equal to 15, diamond 663 is entered and inquiry is made as to whether the walk flag is set. If so, block 655 is entered, and, if not, diamond 664 is entered and the walk counter is tested. If the walk counter is found to be less than 15, it is incremented (block 665). If the walk counter equals 15, the snort routine of FIG. 12 is entered. As will be described hereinbelow, this instance of the snort routine will generally lead to a "power down".

Operation of the just-described portion of the Δ routine is as follows: The diamonds 651, 658, and 663 determine, in the sequence listed, if the trot, gallop, or walk switch was activated during the previous sampling period, and an appropriate mode control is activated. If the trot switch was active during the 110 ms. sampling period (i.e., the trot flag was set), the diamonds 658 and 663 are never reached to inquire regarding gallop and walk switch activation. Similarly, if the gallop flag is determined to have been set (assuming diamond 658 is reached), the diamond 663 is not reached. In this manner, the trot, gallop, walk priority is established. It can be noted that there is no trot mode control activation leading from the "yes" branch of diamond 651. This is because in the main routine of FIG. 5, the trot mode control is assumed to be active if both the gallop and walk mode controls are inactive, by process of elimination. The gallop mode control is activated via the "yes" output branch of diamond 658 (see block 660). The walk mode control is activated during initialization of the Δ routine (block 601 above) and is inactivated when either trot or gallop is active (block 654), but is not inactivated when the "yes" branch of diamond 663 (in those cases when this diamond is reached) indicates a walk switch activation (since block 654 is bypassed in this case). The trot, gallop and walk counters are utilized to insure that a lower mode is not switched to until fifteen Δ time periods (about $1\frac{1}{2}$ seconds) have elapsed without continuance of the mode which was previously active. However, a higher priority mode can be switched to immediately. Accordingly, each time the trot flag is found to be set, the trot counter is restarted at 0 (block 654), and when the trot flag is found to be reset, the trot counter is incremented during each subsequent Δ cycle until the trot counter reaches 15 (diamond 656 and block 657). While the trot counter is active, the gallop counter is inactivated by setting it to 15 (block 653). Also, the walk counter is continuously restarted at 0 (block 655) except when the other counters have run out and no flags are set. Thus, it is seen that exiting via the "yes" branch of diamond 664 will be implemented only when 15 Δ intervals have elapsed since the last switch activation.

Figure 7:
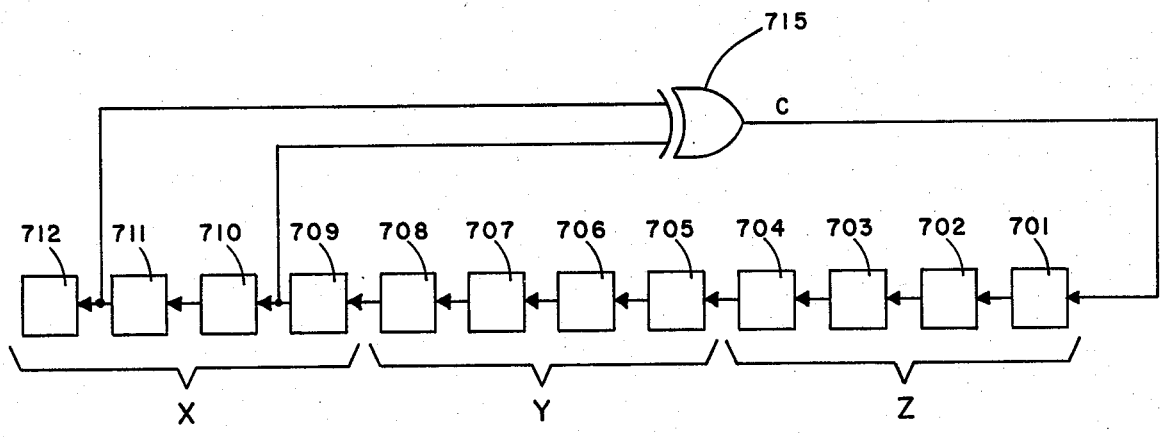
FIG. 7 is a block diagram which illustrates a pseudo-random noise generator.

Before proceeding to describe further the manner in which certain sounds are generated, a brief description will be set forth of a technique employed herein to generate random numbers used in the subsequently disclosed routines. It will be understood, however, that both hardware and softeare implementations of random number generators are well known in the art and other suitable techniques could be utilized. FIG. 7 is a block diagram of a pseudo-random sequence generator which is simulated by the simple routine shown in FIG. 8. The pseudo-random sequence generator 700 includes a string of 12 shift register stages 701–712. The stages 701–704 represent a four-bit binary number designated Z, the four stages 705–708 represent a four-bit binary number designated Y, and the four stages 709–712 represent a four-bit binary number designated X. The output of stage 709 (called bit 0 of X) and the output of stage 711 (called bit 2 of X) are coupled to an exclusive OR gate 715 whose output, designated C, is coupled back to the input of the first shift register stage 701. To generate successive pseudo-random binary numbers, shifts are successively implemented with C coupled back to the first stage.

Figure 8:
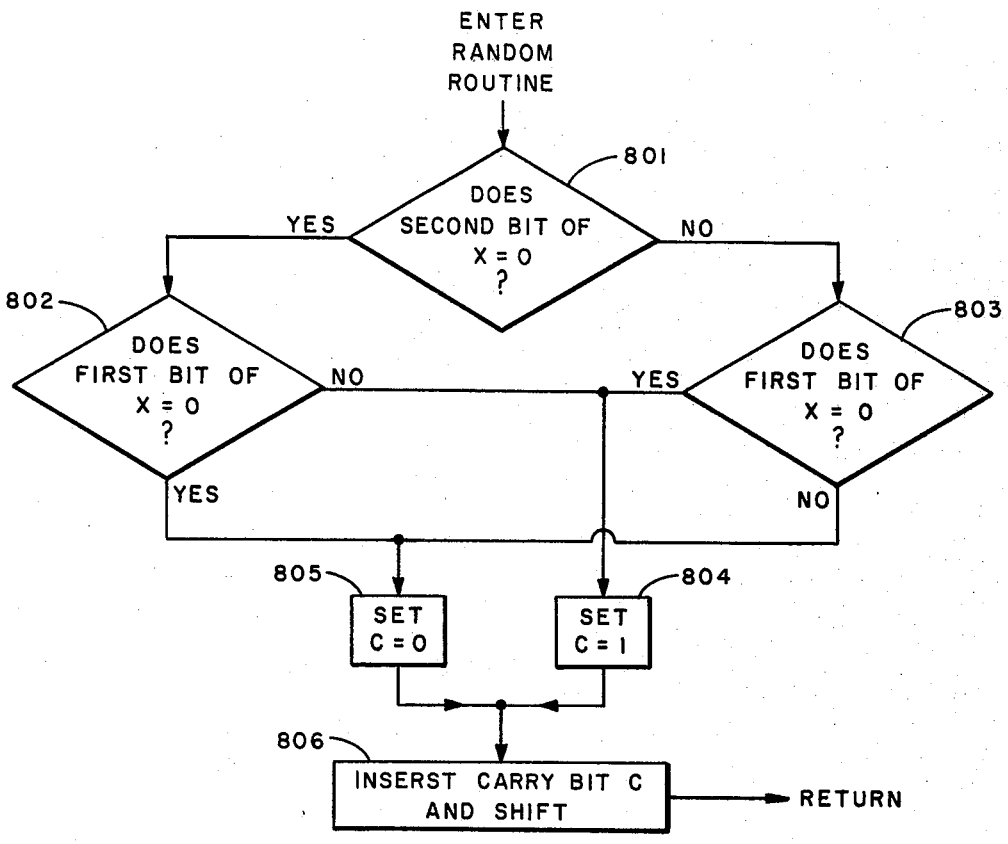
FIG. 8 is a flow diagram of the subroutine utilized to obtain random numbers.

FIG. 8 illustrates a routine for obtaining the random numbers to be used in subsequently described routines. Bit 2 of X (which, like Y and Z, is stored in the present embodiment, in a particular memory location of the microprocessor, rather than in a separate shift register) is initially examined (diamond 801) to determine if it is 0. If so, diamond 802 is entered and bit 0 of X is tested in the same way. If bit 2 of X had been found to be one, diamond 803 is entered and bit 0 of X is tested therein. The "no" and "yes" branches of diamonds 802 and 803 are respectively coupled to block 804, whereas the "yes" and "no" output branches of diamonds 802 and 803 are respectively coupled to block 805. Block 804 represents the setting of carry bit C (see output of exclusive OR gate 715 in FIG. 7) to a 1, whereas the block 805 represents the setting of carry bit C to a 0. The block 806 is then entered, this block representing the feedback of the carry bit C and the shifting of the register 700 (FIG. 7). In the implementation of the FIG. 8 routine, however, the shifting is effected by changing memory locations in the microprocessor. In operation, it can be seen that the blocks 801 through 805 represent the exclusive OR gate 715 of FIG. 7 in that when the two bits examined are dissimilar, the carry bit is 1 (block 804), whereas when the two bits are alike, the carry bit is 0 (block 805).

Figure 9:
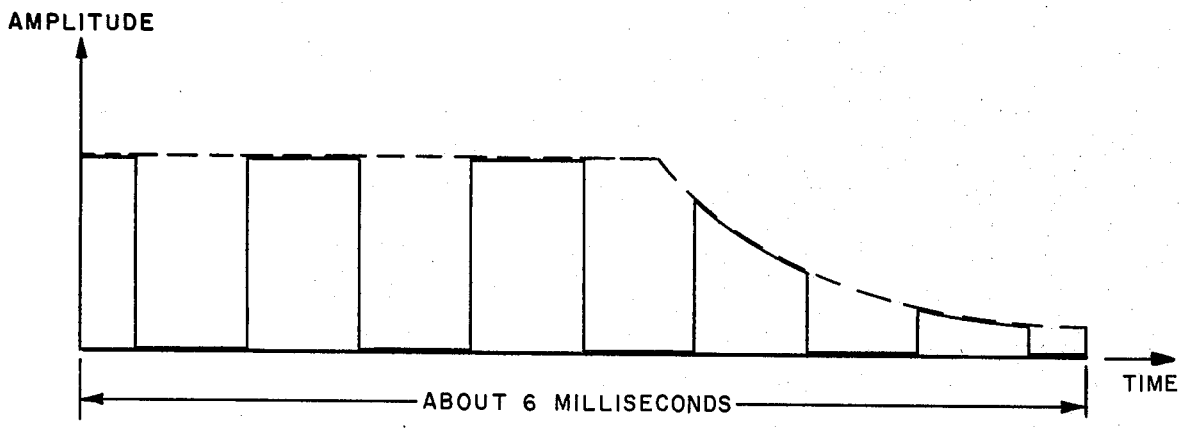
FIG. 9 illustrates the waveform of the "clop" sound generated in accordance with the invention.

Referring to FIG. 9, there is shown a waveform which illustrates the clop sound that is generated and used to simulate each of the gaits in accordance with the patterns of clops shown in FIG. 4. The digitally synthesized clop waveform has an envelope which persists at a steady state value for time of about 3 milliseconds and then decays for about another 3 milliseconds. The frequency of the actual signal under the envelope is varied somewhat at random, as this is found to effectively simulate the slight difference in sound of successive hoofbeats, and results in more realistic sounding gaits. The envelope is generated by controlling the base voltage of transistor Q1 (FIG. 2) via microprocessor output lines L4, L5 and L6. The signal modulated by the base voltage of Q1 is applied via output line DO. This signal, in turn, drives transistor Q2 and speaker 101 to generate the desired sounds.

FIG. 10 is a flow chart of the routine utilized to obtain the clop sound whose waveform is shown in FIG. 9. The random routine (FIG. 8) is called to obtain a two-bit random number (block 1001). Block 1002 is then entered and L5 is set low while L4 and L6 are set high. In the case of L4 and L5, which are open drain, the designation "low" means floating and the designation "high" means ground reference potential. Thus, C1 and R5 are out of the circuit. This means that the full battery voltage (e.g., nine volts) will be applied across speaker 101 and results in the steady state portion of the signal envelope (FIG. 9). Also, an index J, used in this case to keep track of the number of signal cycles which define the envelope steady state and decay durations, is initialized a 1. A delay of six instructions (block 1003) is followed by the complementing of the DO line outut (FIG. 2) as represented by block 1004. The six instruction delay, in addition to the time required to execute the other instructions, represents a fixed delay time for each half cycle of the signal under the envelope. Inquiry is then made (diamond 1005) as to whether the DO line is high and, if so, block 1006 is entered and a delay time of six instruction cycles is implemented. If the DO line is low, however, diamonds 1007 and 1008 are successively entered, the diamond 1007 inquiring into the status of the first bit of the previously obtained two-bit random number, and the diamond 1008 inquiring as to the status of the second bit of the two-bit random number. In the case of diamond 1007, no additional delay is implemented if the first bit is a 1 and two instruction cycles of additional delay are implemented if the first bit is a zero (block 1009). The same is true of diamond 1008, except that one instruction cycle of additional delay is used (block 1010). It can be seen that the result of the blocks 1007 through 1010 is that either zero, one, two, or three instruction cycles of additional delay for the current half-cycle are implemented, depending upon the two-bit random number. Diamond 1011 is then entered and the index J is tested to see if it has reached six. If not, index J is incremented (block 1012), tested again to determine if it has reached 13 (diamond 1013), and the block 1004 is reentered. In this manner, three full cycles of waveform are generated under the steady state portion of the envelope (FIG. 9), with a half-cycle of each cycle having an additional delay of six instruction cycles (block 1006) and the other half-cycle of each cycle having an additional delay of between zero and three instruction cycles, depending upon the two-bit random number (blocks 1007 through 1010). In practice, with a basic instruction cycle taking about 16 microseconds, this results in random frequency variations of the clops between about 840 and 910 Hz. After six cycles at the signal frequency, output line L6 is brought low (block 1014) and the envelope decay is achieved due to the discharge of C2 via R4 (FIG. 2). Thus, Q1 acts as a clipper to shape the envelope. Representative values of C2 and R4 are 0.075 microfarads and 27K ohms, respectively. The decay continues during another six cycles until the index J equals 13, whereupon the routine is exited.

Figure 11:
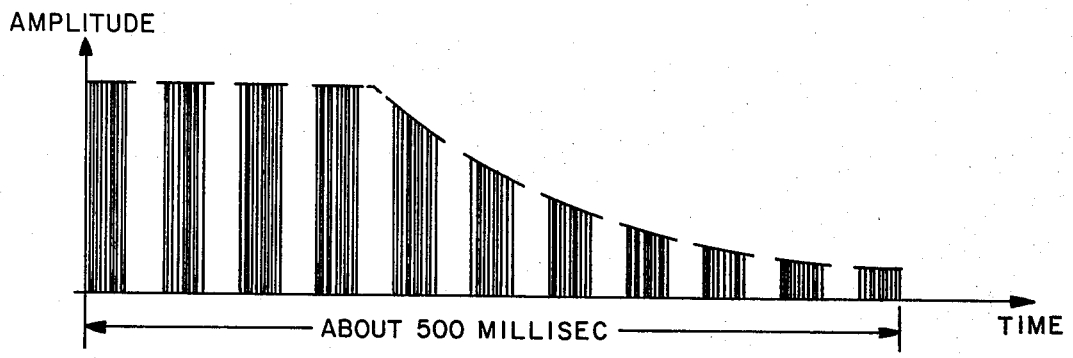
FIG. 11 illustrates the waveform of the "snort" sound generated in accordance with the invention.

Referring to FIG. 11, there is shown the waveform of the signal used to generate the snort sound. The snort has an envelope with a steady state portion that lasts for about 300 milliseconds. Under the envelope, alternating periods of random noise and silence are generated. The result is a sound that realistically simulates the snort of a horse.

FIG. 12 illustrates a flow diagram utilized to obtain the snort sound whose waveform is illustrated in FIG. 11. Block 1201 is entered and output lines L4 and L5 (FIG. 2) are brought low and L6 is brought high to implement the steady state portion of the envelope. Also, an index K is initialized at one. Block 1202 is then entered and an index M is initialized at zero. Index M is used to keep track of the time of each noise burst. Block 1203 is then entered, this block representing the calling of the random routine of FIG. 8, the random routine being utilized in this instance to generate a random sequence of numbers to obtain a random noise signal (i.e., a signal having a randomly distributed frequency). This is achieved by having the DO line output (FIG. 2) equal a selected bit of the random sequence (block 1204) so that for each pass through the loop 1205, the state of the DO line (i.e., either high or low) will depend upon the next random binary bit of the sequence. The first bit of Z (FIG. 8) is used for this purpose. As noted, the number of passes through the loop 1205 is counted by the index M, which is incremented (block 1206) and tested (diamond 1207) during each pass through the loop.

When M is found to be 48 (diamond 1207) , which takes about 22 milliseconds, output line DO is set low (block 1208) and 22 milliseconds of delay are implemented (block 1209), this resulting in 22 milliseconds of silence. Diamond 1210 is then entered and index K, used to keep track of the number of noise/silence cycles is tested to determine if it equals 4. If not, K is incremented (block 1212) and bursts of noise and silence are continued. When K equals 4, the envelope decay is started (block 1211) by bringing L6 low. The capacitors C1 and C2 then decay through resistor R4. Capacitor C1 has a representative value of 10 microfarads, and results in a relatively long time constant of decay as compared to the decay of the clop wherein only C1 (e.g. 0.075 microfarads) was discharging. After incrementing of K, K is tested (diamond 1213) to determine whether or not the snort is complete; i.e., whether 11 noise/silence bursts have been generated. When completion is indicated, diamond 1214 is entered and the status of the walk flag is examined. If the walk flag is set, a return to the next Δ routine is indicated. If not (viz., 15 Δ time periods have occurred with no walk switch activation) then block 1215 is entered to effect a power down by bringing L7 high.

Figure 13:
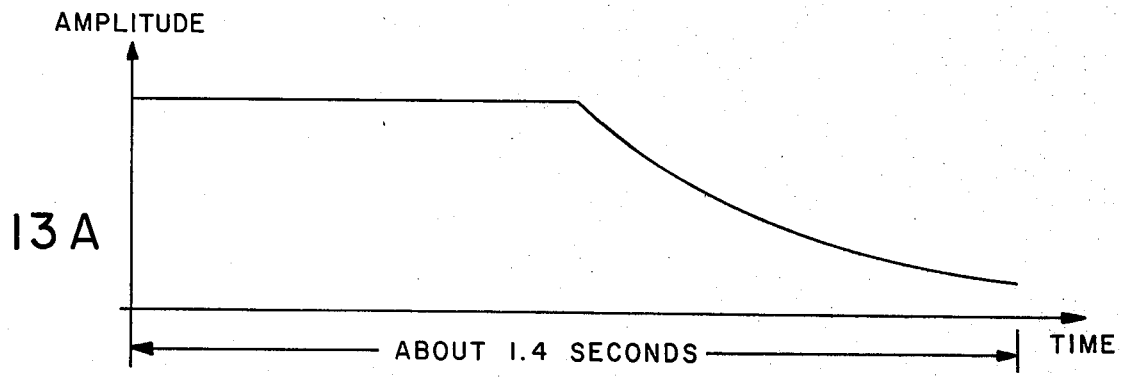
FIG. 13A illustrates the amplitude characteristic of the waveform of the "whinny" sound.
FIG. 13B illustrates the frequency characteristic of the waveform of the "whinny" sound.
Figure 13:
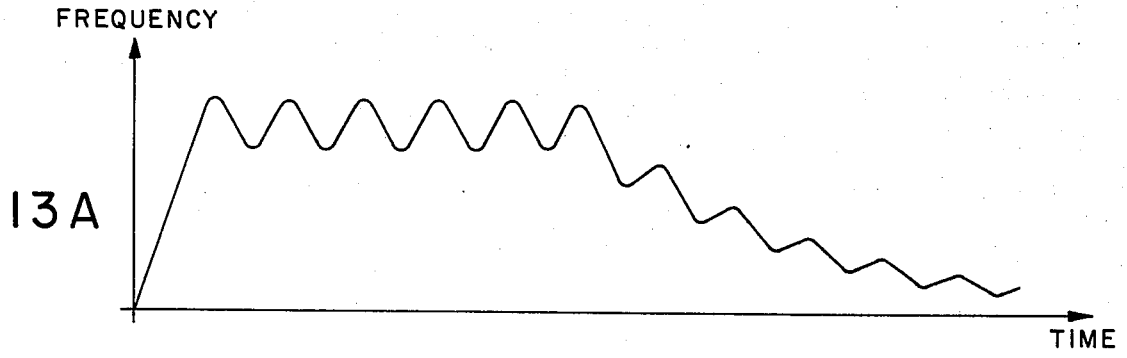

FIG. 13 illustrates the characteristics of the signal used to generate the whinny sound, the graph of FIG. 13A illustrating the wave envelope, and the graph of FIG. 13B illustrating the frequency versus time characteristic of the waveform. The envelop has a steady state value followed by a decay portion similar to previously described waveforms. The steady state and decay portions of the envelope each last for about 700 milliseconds. The frequency characteristic is seen to sweep up to a particular frequency value, oscillate around that value, and then oscillate as it decays.

Figure 14:
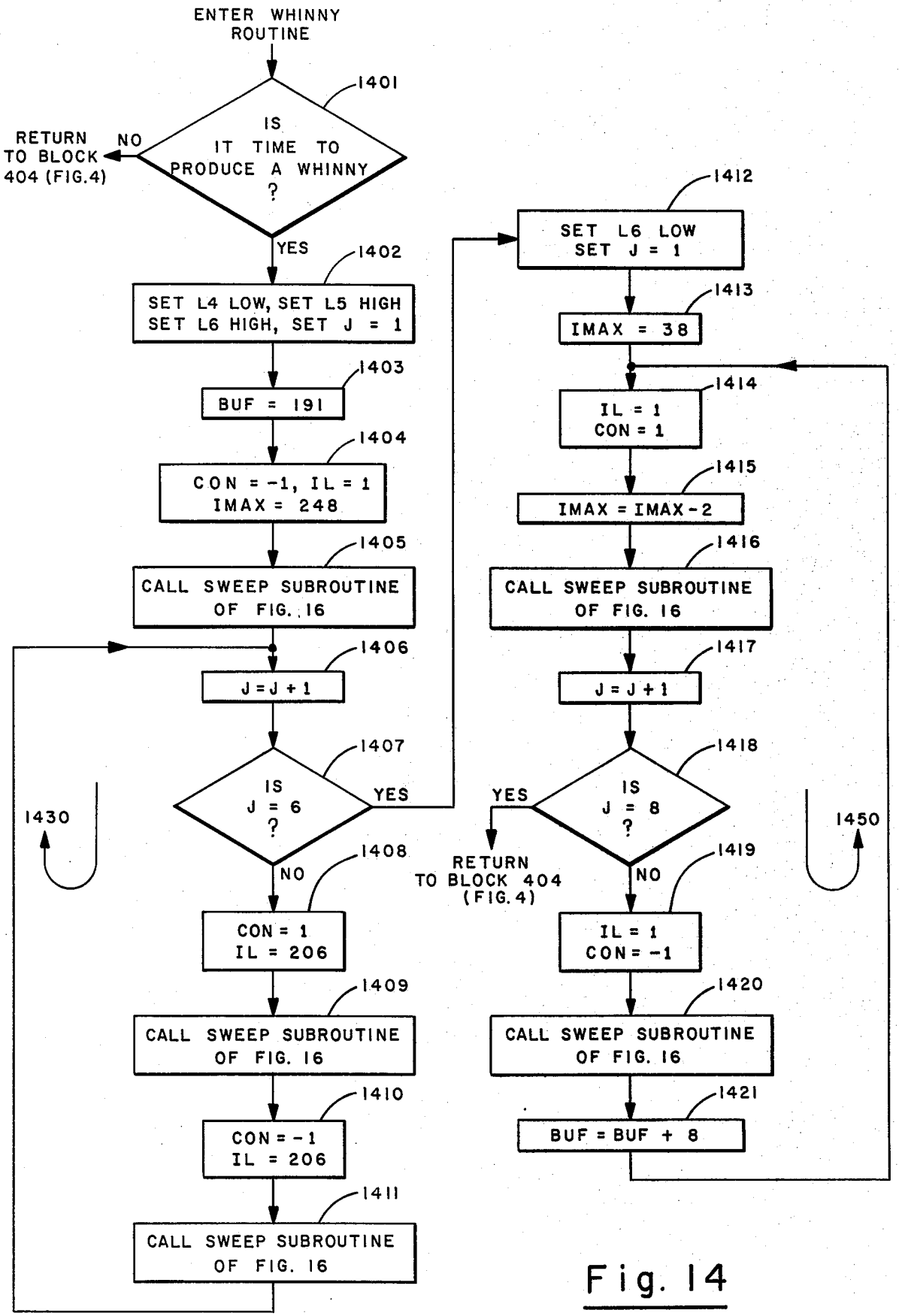
FIG. 14 is a flow diagram of the routine utilized to generate the whinny sound.
Figure 15:
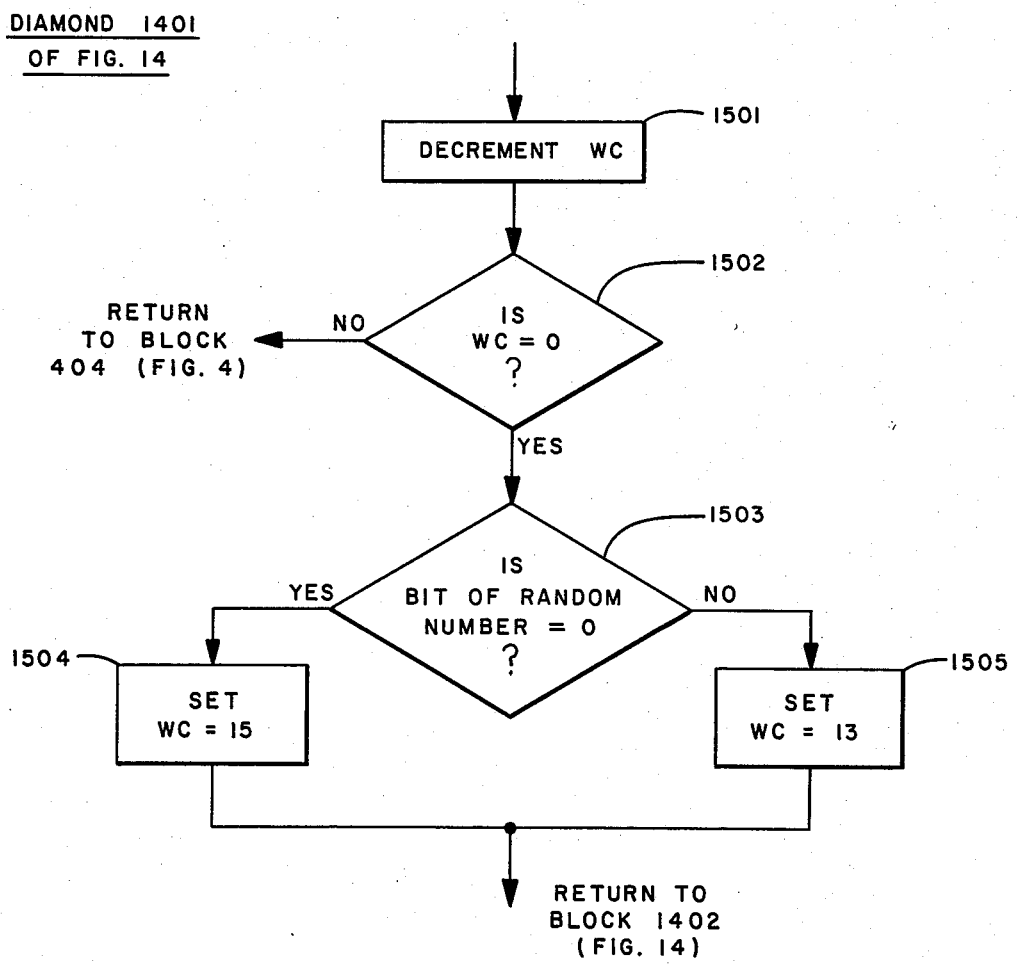
FIG. 15 is a flow diagram of the subroutine utilized to determine if a whinny should be generated.

Referring to FIG. 14, there is shown a flow diagram of the routine for obtaining the whinny sound represented by the characteristics of FIG. 13. Diamond 1401 is initially entered and determination is made as to whether it is time to produce a whinny. The subroutine for this determination is set forth in FIG. 15, which will be referred to at this point. A whinny counter, designated WC and which can be initialized to any desired value after power-up, is decremented, as represented by block 1501. The whinny counter is then tested to determine if it has reach zero. If not, the whinny routine is exited and block 404 of the main program routine (FIG. 4) is returned to (this being the same as the "no" output branch of diamond 1401 in FIG. 14). If the whinny counter has reached 0, however, a bit from the random routine (FIG. 8) is obtained and tested (diamond 1503). If the bit equals 0, the whinny counter is set at 15 (block 1504), whereas if the bit equals 1, the whinny counter is set at 13 (block 1505). In operation, the whinny routine is called once each time around the main program loop (FIG. 4), each such loop time taking about 1½ seconds. It is readily seen that a whinny will be produced only once each 13 or 15 times around the loop, depending upon whether the random bit is a 1 or a 0. In this manner, the whinnies are made to occur at irregular intervals, which results in more realistic sound effects.

Figure 16:
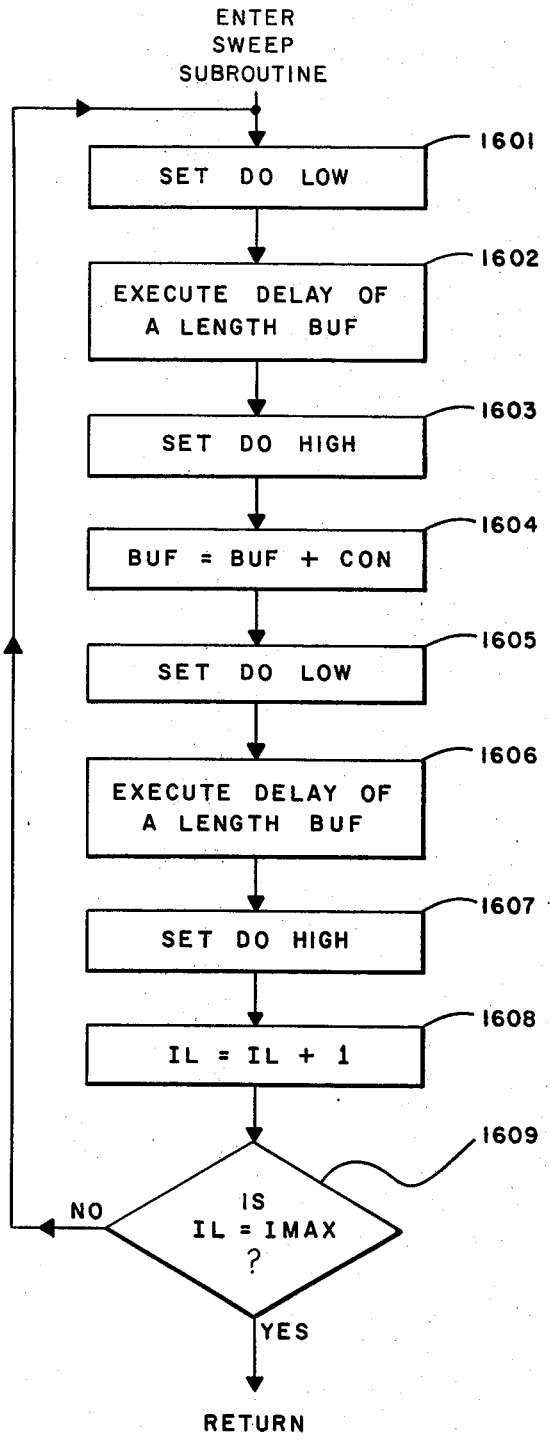
FIG. 16 is a flow diagram of the frequency sweep subroutine utilized in the routine of FIG. 15.

Returning to FIG. 14, and assuming it is a time at which a whinny is to be produced, block 1402 is entered and lines L5 and L6 are set high and L4 is set low. Also, an index J is initialized at 1. A further index, BUF, is initialized at 191 (block 1403). Indices IL and IMAX are initialized at 1 and 248, respectively, and variable CON is set to −1 (block 1404). Block 1405 is then entered, this block representing calling of a sweep subroutine which is set forth in FIG. 16, and which is utilized to achieve a sweep in frequency. Before continuing with description of FIG. 14, reference will be made to FIG. 16. FIG. 16 will be referred to to explain the sweep subroutine.

In FIG. 16, line DO (FIG. 2) is set low, as indicated by block 1601. Block 1602 is then entered, and a delay is executed, the length of the delay depending upon the index BUF. Line DO is then set high, as represented by block 1603. The value of BUF is then modified by adding CON to BUF, as represented by block 1604. Line DO is then again set low (block 1605), and another delay is executed the length of the delay again depending upon BUF (block 1606). Line DO is then set high once again (block 1607). The index IL is then incremented (block 1608) and then tested (diamond 1609) to determine if it has reached a predetermined maximum value designated IMAX. If not, block 1601 is reentered. When IMAX is reached, the sweep subroutine is exited. It will thus be understood how the sweep subroutine achieves a sweep in frequency by successively changing the delay of an alternating signal, thereby changing the period of each half-cycle. As output line DO is alternated back and forth between its high and low values, (blocks 1601, 1603, 1605 and 1607) the delay at each value (BUF—as determined by blocks 1602 and 1606) is incremented by CON (block 1604). The polarity of CON determines whether the period gets shorter (i.e., higher frequency) or longer (i.e., lower frequency). The value of IMAX determines the number of passes through the sweep subroutine loop and, accordingly, the duration of the frequency sweep.

Returning to FIG. 14, it will now be understood that the sweep subroutine of block 1405 achieves a relatively long sweep upward in frequency since CON was initially set to −1 and IMAX was initially set to the relatively high value of 248. This results in the initial sweep up in frequency illustrated in FIG. 13B.

The loop 1430 is next entered, this loop being used to generate the center portion of the frequency characteristic shown in FIG. 13B; i.e., wherein the frequency oscillates about a steady state frequency value. Block 1406 is entered and the index J, which is used to keep track of the number of traversals through loop 1430, and was initially set to one (block 1402), is incremented. Index J is then tested to determine if it has reached 6 (diamond 1407) and, if not, block 1408 is entered. The value of CON is then set to +1 and the value of IL is set to 206. Block 1409 is then entered, this block representing the calling of the frequency sweep subroutine of FIG. 16. After completion of the sweep subroutine, block 1410 is entered and CON is set to −1 and IL is again set to 206. The sweep subroutine of FIG. 16 is then called again (block 1411) and, after completion of the sweep subroutine, the block 1406 is reentered. In operation of the loop 1430, the blocks 1408 and 1409 effect a sweep down in frequency, and the blocks 1410 and 1411 effect a sweep up in frequency, so that the loop results in the type of frequency characteristic shown in the center portion of the FIG. 13B graph. The duration of the sweeps are much shorter than in the case of the original sweep up in frequency, this being achieved by initializing IL for each sweep at a relatively high value of 206 (i.e., the difference between IMAX and IL is only 42, whereas it was 247 for the original sweep up).

In the next portion of the whinny routine (loop 1450), the envelope amplitude decays and the frequency characteristic also decays while continuing to oscillate. Block 1412 is entered and output line L6 (FIG. 2) is set low to begin the amplitude envelope decay as the capacitors C1 and C2 discharge. Also, index J, used to keep track of the number of traversals through the subsequent loop, is initialized at 1. The IMAX used to determine the duration of each frequency sweep is initialized at 38 (block 1413). Block 1414 is then entered and IL is initialized at 1, and CON is set at 1. Next, block 1415 is entered and IMAX is decremented by two. The sweep routine of FIG. 16 is then called, as represented by block 1416. Index J is then incremented (block 1417) and tested (block 1418) to determine whether the prescribed number of traversals through the loop have been effected. If not, block 1419 is entered, this block representing the reinitializing of IL to 1 and the setting of CON to −1. The sweep routine of FIG. 16 is then called again (block 1420). The value of BUF (which has been set above—block 1403) is then incremented by 8 (block 1421), and block 1414 is then reentered.

In operation of the loop 1450 successive sweeps up and down are obtained by alternating the sign of CON (block 1415 and block 1419). The frequency decay is obtained by incrementing BUF, since BUF is determinative of the delay in the frequency sweep routine of FIG. 16. (see block 1604). Aslo, the number of cycles in the oscillatory sweeps are made smaller as the frequency decays (by decrementing IMAX—block 1415), this being done to keep the time of the individual frequency sweeps substantially constant.

We claim:

1. A riding toy comprising:

a model horse resiliently mounted to allow a rider thereof to cause motion of the horse having vertical and horizontal motion components;

means for detecting horizontal and vertical components of motion of said horse;

means for generating a trotting gait sound in response to the output of said vertical motion detection; and means for generating a walk or gallop gait sound in response to said horizontal motion detection;

said means for generating said gait sounds including means for selecting, in accordance with a prescribed priority, which of said gait sounds is to be generated when said motion detection would otherwise result in the generation of more than one gait sound.

2. A riding toy as defined by claim 1 wherein said means for generating a walk or gallop gait sound is also responsive to the amplitude of detected horizontal motion components and operative to generate said gallop gait sound when said detected horizontal motion components are above a preselected amplitude.

3. A riding toy as defined by claim 2 wherein said means for generating said gait sounds comprise means for generating a basic clop sound, and means for repeating the clop sound in a different time sequence for each gait.

4. A riding toy comprising:

a model horse resiliently mounted to allow a rider thereof to cause motion of the horse having vertical and horizontal motion components;

means for detecting horizontal and vertical components of motion of said horse;

means for generating a trotting gait sound in response to the output of said vertical motion detection; and means for generating a walk or gallop gait sound in response to said horizontal motion detection;

said means for generating said gait sounds comprising means for generating a basic clop sound, and means for repeating the clop sound in a different time sequence for each gait.

5. A riding toy as defined by claim 4 further comprising means responsive to detected motion of said horse for generating sounds which simulate oral or nasal sounds made by a living horse.

6. A riding toy as defined by claim 3 further comprising means response to detected motion of said horse for generating sounds which simulate oral or nasal sounds made by a living horse.

7. A riding toy as defined by claim 5 wherein said oral or nasal sounds comprise sequences of snorts and whinnies.

8. A riding toy as defined by claim 6 wherein said oral or nasal sounds comprise sequences of snorts and whinnies.

9. A riding toy as defined by claim 1 wherein said means for detecting components of motion comprise first and second motion-sensitive switches oriented in different directions.

10. A riding toy as defined by claim 4 wherein said means for detecting components of motion comprise first and second motion-sensitive switches oriented in different directions.

11. A riding toy as defined by claim 1 wherein said means for detecting components of motion comprise first and second motion-sensitive switches oriented in substantially vertical and horizontal directions, and a third motion-sensitive switch oriented at an angle between the orientations of said first and second switches; and further comprises means for periodically sampling the states of said switches.

12. A riding toy as defined by claim 2 wherein said means for detecting components of motion comprise first and second motion-sensitive switches oriented in substantially vertical and horizontal directions, and a third motion-sensitive switch oriented at an angle between the orientations of said first and second switches; and further comprises means for periodically sampling the states of said switches.

13. A riding toy as defined by claim 3 wherein said means for detecting components of motion comprise first and second motion-sensitive switches oriented in substantially vertical and horizontal directions, and a third motion-sensitive switch oriented at an angle between the orientations of said first and second switches; and further comprises means for periodically sampling the states of said switches.

14. A riding toy as defined by claim 2 wherein said means for generating sounds comprises a speaker; means for digitally generating audio frequency signals; envelope generating means for controlling the envelope of said audio frequency signals; and means for driving said speaker with the controlled audio frequency signals.

15. A riding toy as defined by claim 3 wherein said means for generating sounds comprises a speaker; means for digitally generating audio frequency signals; envelope generating means for controlling the envelope of said audio frequency signals; and means for driving said speaker with the controlled audio frequency signals.

16. For use in conjunction with a riding toy which includes a model horse resiliently mounted to allow a rider thereof to cause motion of the horse having vertical and horizontal motion components; a subsystem comprising:

means for detecting horizontal and vertical components of motion of said horse;

means for generating a trotting gait sound in response to the output of said vertical motion detection; and means for generating a walk or gallop gait sound in response to said horizontal motion detection;

said means for generating said gait sounds including means for selecting, in accordance with a prescribed priority, which of said gait sounds is to be generated when said motion detection would otherwise result in the generation of more than one gait sound.

17. For use in conjunction with a riding toy which includes a model horse resiliently mounted to allow a rider thereof to cause motion of the horse having vertical and horizontal motion components; a subsystem comprising:

means for detecting horizontal and vertical components of motion of said horse;

means for generating a trotting gait sound in response to the output of said vertical motion detection; and means for generating a walk or gallop gait sound in response to said horizontal motion detection;

said means for generating said gait sounds comprising means for generating a basic clop sound, and means for repeating the clop sound in a different time sequence for each gait.

18. A subsystem as defined by claim 17 wherein said means for generating a basic clop sound is operative to vary at random the frequency components as between successive basic clop sounds.

19. A riding toy comprising:

a model horse resiliently mounted to allow a rider thereof to cause motion of the horse having vertical and horizontal motion components;

first and second motion-sensitive switches oriented in two different directions; and means responsive to said motion-sensitive switches for generating at least two different gait sounds, said generating means including means for generating a basic clop sound, and means for repeating the clop sound in a different time sequence for each gait.

20. A riding toy as defined by claim 19 wherein said different gait sounds are a trotting gait and a galloping gait.

21. A riding toy comprising:

a model horse resiliently mounted to allow a rider thereof to cause motion of the horse in at least two different directions;

first and second motion-sensitive switches oriented in different directions; and means responsive to the states of said switches for generating at least two different gait sounds by generating different timing patterns of a basic sound.

22. A riding toy as defined by claim 21 wherein said motion-sensitive switches are electronic switches, and further comprising means for periodically sampling the states of said switches.

* * * * *